US010632354B2

(12) United States Patent
Loudenslager

(10) Patent No.: US 10,632,354 B2
(45) **Date of Patent: *Apr. 28, 2020**

(54) GOLF CLUB BAG SUPPORT MECHANISMS AND RELATED METHODS

(71) Applicant: KARSTEN MANUFACTURING CORPORATION, Phoenix, AZ (US)

(72) Inventor: John H. Loudenslager, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/167,687

(22) Filed: Oct. 23, 2018

(65) Prior Publication Data

US 2019/0054355 A1 Feb. 21, 2019

Related U.S. Application Data

(63) Continuation of application No. 14/256,277, filed on Apr. 18, 2014, now Pat. No. 10,124,222, which is a continuation of application No. 13/268,160, filed on Oct. 7, 2011, now Pat. No. 8,752,798.

(60) Provisional application No. 61/478,448, filed on Apr. 22, 2011.

(51) Int. Cl.

| | |
|---|---|
| ***A63B 55/57*** | (2015.01) |
| ***A63B 55/53*** | (2015.01) |
| ***A63B 55/50*** | (2015.01) |

(52) U.S. Cl.

CPC ..... *A63B 55/57* (2015.10); *A63B 55/50* (2015.10); *A63B 55/53* (2015.10); *Y10T 29/49826* (2015.01)

(58) Field of Classification Search

CPC ..... A63B 55/57; A63B 55/50; A63B 55/53

USPC ..... 248/96, 127, 163.1, 166, 168, 170, 173, 248/188.8, 351, 354.5, 440.1, 688, 97, 248/136, 150, 165; 280/DIG. 6; 206/315.3, 315.7; 403/150, 151

See application file for complete search history.

(56) References Cited

U.S. PATENT DOCUMENTS

| | | | |
|---|---|---|---|
| 1,769,011 | A | 7/1930 | Bickford |
| 2,148,947 | A | 2/1939 | Jackson |
| 2,919,881 | A | 1/1960 | Eames |
| 4,282,983 | A | 8/1981 | Swartzbaugh |
| 4,735,394 | A | 4/1988 | Facco |
| 4,834,235 | A | 5/1989 | Solheim et al. |
| 4,898,352 | A | 2/1990 | Hoffman |
| 5,160,109 | A | 11/1992 | De Leeuw |
| 5,339,951 | A | 8/1994 | Chen |
| 5,351,921 | A | 10/1994 | Chen |
| 5,407,155 | A | 4/1995 | Chung |
| 5,529,385 | A | 6/1996 | Tsao |
| 5,799,786 | A | 9/1998 | Beck et al. |
| 5,816,544 | A | 10/1998 | Hsieh |
| 5,823,485 | A | 10/1998 | Park |
| 5,997,105 | A | 12/1999 | Wu |
| 6,068,270 | A | 5/2000 | Kim |
| 6,220,433 | B1 | 4/2001 | Kang |

(Continued)

FOREIGN PATENT DOCUMENTS

| | | |
|---|---|---|
| CN | 201299169 | 9/2009 |
| GB | 2333712 | 8/1999 |
| JP | H8-289948 | 11/1996 |

*Primary Examiner* — Kimberly T Wood

(57) ABSTRACT

Embodiments of golf bag support mechanisms are disclosed herein. Other examples and related methods are also generally described herein.

18 Claims, 7 Drawing Sheets

(56) References Cited

U.S. PATENT DOCUMENTS

| | | | |
|---|---|---|---|
| 6,234,582 | B1 | 5/2001 | Wu |
| 6,296,117 | B1 | 10/2001 | Chen |
| 6,311,836 | B1 | 11/2001 | Maeng |
| 6,382,572 | B1 | 5/2002 | Lin |
| 6,481,674 | B1 | 11/2002 | Lin |
| 6,494,416 | B2 | 12/2002 | Wang |
| 6,572,060 | B2 | 6/2003 | Yoon |
| 6,726,157 | B2 | 4/2004 | Yoon |
| 6,834,891 | B2 | 12/2004 | Matsubara et al. |
| 7,445,399 | B2 | 11/2008 | Dunn et al. |
| 7,617,931 | B2 | 11/2009 | Shiao |
| 8,573,393 | B2 | 11/2013 | Cole et al. |
| 2008/0135431 | A1 | 6/2008 | Tan |

3100

GOLF CLUB BAG SUPPORT MECHANISMS AND RELATED METHODS

CROSS-REFERENCE TO RELATED APPLICATIONS

This is a continuation of U.S. application Ser. No. 14/256,277, filed on Apr. 18, 2014, which is a continuation of U.S. patent application Ser. No. 13/268,160, filed on Oct. 7, 2011, and issued as U.S. Pat. No. 8,752,798, which claims priority to U.S. Provisional Patent Application No. 61/478,448, filed on Apr. 22, 2011. The contents of the disclosures listed above are incorporated herein by reference.

TECHNICAL FIELD

This disclosure relates generally to sports equipment, and relates more particularly to golf club bag support mechanisms and related methods.

BACKGROUND

Golf bag support mechanisms are often incorporated into or coupled to a golf bag to assist supporting the golf bag over a playing surface, while at the same angling golf clubs contained in the golf bag for easy identification, extraction, and insertion by a user. Although golf bag support mechanisms exist in retractable configurations, such mechanisms often degrade over time or under heavy loads. As a result, such mechanisms may fail to maintain a desired extension angle, may fail to properly support the golf bag over the playing surface, and/or may fail to maintain the golf clubs at an adequate angle for proper inspection, insertion, or removal from the golf bag. Considering the above, further developments in golf bag support mechanisms and related methods will enhance the utilities and features provided by golf bags.

Figure 1:
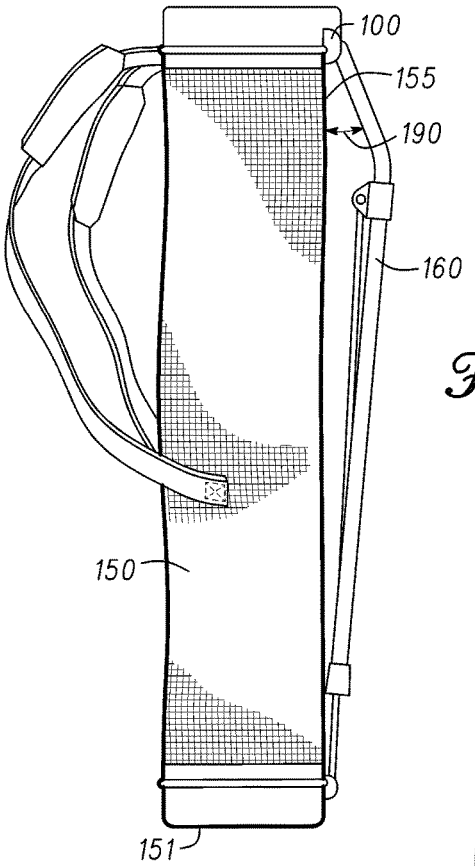
FIG. 1 illustrates a side view of an exemplary golf bag support mechanism coupled to a golf bag and in a retracted configuration.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf clubs and their methods of manufacture. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf clubs and methods of manufacture described herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein. The term "coupled," as used herein, is defined as directly or indirectly connected in an electrical, physical, mechanical, or other manner.

DESCRIPTION

In one embodiment, a golf bag support mechanism comprises a bracket and a first hinge member. The bracket can comprise a bracket wall comprising an outer bracket side and an inner bracket side opposite the outer bracket side, and a first dock adjacent to the outer bracket side of the bracket wall. The first hinge member can be configured for hinged coupling with the first dock, and can comprise a first top end, a first bottom end opposite the first top end, a first sidewall extended between the first top end and the first bottom end, a first protrusion at the first top end and comprising a stop portion, and a first bore bounded by the first sidewall. A first axis extends through a centerpoint of the first protrusion and between the first top end and the first bottom end. The first dock can comprise a first notch extending into the outer bracket side of the bracket wall. When the golf bag support mechanism is in a retracted configuration, a retracted angle exists between the first axis and the bracket wall, and the first protrusion is decoupled from the first notch. When the golf bag support mechanism is in an extended configuration, an extended angle greater than the retracted angle exists between the first axis and the bracket wall, and the stop portion of the first protrusion is received at the first notch.

In one example, a method for providing a golf bag support mechanism can comprise providing a bracket and providing a first hinge member. The bracket can comprise a bracket wall comprising an outer bracket side and an inner bracket side opposite the outer bracket side, and a first dock adjacent to the outer bracket side of the bracket wall, the first dock comprising a first notch extending into the outer bracket side of the bracket wall. The first hinge member can be configured to be hingedly coupled to the first dock. Providing the first hinge member can comprise providing a first top end, providing a first bottom end opposite the first top end, providing a first sidewall extended between the first top end and the first bottom end, providing a first protrusion at the first top end and comprising a stop portion, and providing a first bore bounded by the first sidewall. A first axis can extends through a centerpoint of the first protrusion and between the first top end and the first bottom end. The golf bag support mechanism can be configurable for a retracted configuration where a retracted angle exists between the first axis and the bracket wall, and where the first protrusion is decoupled from the first notch. The golf bag support mechanism can be also configurable for an extended configuration where an extended angle greater than the retracted angle exists between the first axis and the bracket wall, where the stop portion of the first protrusion is received at the first notch.

In one embodiment, a golf bag can comprise a bag sidewall, first and second support legs, a bracket, first and second clevis pins; and first and second hinge members. The bracket can comprise (a) a bracket wall having an outer bracket side and an inner bracket side opposite the outer bracket side, the bracket wall configured to be coupled with, and substantially parallel to, the bag sidewall, (b) a first dock at the outer bracket side of the bracket wall, the first dock comprising a first notch extending into the outer bracket side of the bracket wall, and (c) a second dock at the outer bracket side of the bracket wall, the second dock comprising a second notch extending into the outer bracket side of the bracket wall. The first hinge member can be configured to be hingedly coupled to the first dock by the first clevis pin. The second hinge member can be configured to be hingedly coupled to the second dock by the second clevis pin. The first hinge member can comprises a first top end, a first bottom end opposite the first top end, a first protrusion centered at the first top end and comprising a stop portion. The stop portion can be rounded and can comprising one of a first protrusion end of the first protrusion, or a second protrusion end of the first protrusion, the second protrusion end being opposite the first protrusion end. The first hinge member also can comprise a first sidewall extended between the first top end and the first bottom end, a first axis extended through a centerpoint of the first protrusion and between the first top end and the first bottom end, and a first bore bounded by the first sidewall, extended into the first bottom end towards the first top end, and centered about the first axis. The first sidewall of the first hinge member can comprise a first sidewall end comprising a first hinge aperture, a second sidewall end opposite the first sidewall end, the second sidewall end comprising a second hinge aperture, a third sidewall end located between the first and second sidewall ends and towards the first protrusion end of the first protrusion, and a fourth sidewall end located between the first and second sidewall ends and towards the second protrusion end of the first protrusion. The first dock can comprises a first back wall comprising the first notch, and first and second ears coupled substantially perpendicular to, and at opposite ends of, the first back wall. The first ear can comprise a first ear aperture, and the second ear can comprise a second ear aperture. The first clevis pin can be insertable along a hinge axis of the first hinge member into a hinge position to hinge the first hinge member with the first dock. The hinge position can comprise the first clevis pin inserted into the first ear aperture, through the first hinge aperture, the first bore, and the second hinge aperture, and out the second ear aperture. A bottom portion of the first notch can be rounded complementarily with the stop portion of the first protrusion. The golf bag can be configurable for a retracted configuration where a retracted angle exists between the first axis and the bracket wall, and where the first protrusion is decoupled from the first notch. The golf bag can also be configurable for an extended configuration where an extended angle greater than the retracted angle exists between the first axis and the bracket wall, and where the stop portion of the first protrusion is received at the first notch. The first hinge member can be attachable to the first dock in either of (a) a first orientation wherein the third sidewall end faces the first back wall of the first dock when the golf bag is in the retracted configuration and the first protrusion end engages the first notch when the golf bag is in the extended configuration, or (b) a second orientation wherein the fourth sidewall end faces the first back wall of the first dock when the golf bag is in the retracted configuration and the second protrusion end engages the first notch when the golf bag is in the extended configuration.

Other examples and embodiments are further disclosed herein. Such examples and embodiments may be found in the figures, in the claims, and/or in the present description.

Figure 2:
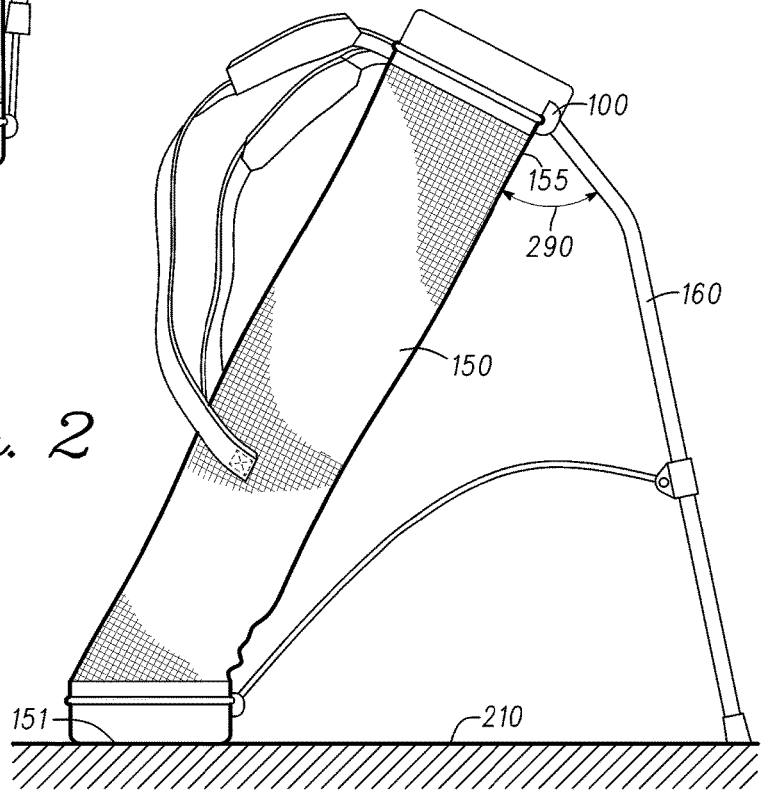
FIG. 2 illustrates a side view of the golf bag support mechanism coupled to the golf bag and in an extended configuration.

Turning now to the figures, FIG. 1 illustrates a side view of an exemplary golf bag support mechanism 100 coupled to golf bag 150 and in a retracted configuration. Golf bag support mechanism 100 is shown coupled to legs 160 in the present example, where legs 160 are retracted relative to golf bag 150. FIG. 2 illustrates a side view of golf bag support mechanism 100 coupled to golf bag 150 and in an extended configuration, with legs 160 extended relative to golf bag 150 so as to support golf bag 150 in conjunction with golf bag bottom 151 over support surface 210. In some examples, support surface 210 can comprise a ground surface, such as a grass or dirt surface, or a substantially flat concrete or other surface.

Golf bag support mechanism 100 is configure to permit legs 160 to extend between the retracted configuration of FIG. 1 to the extended configuration of FIG. 2, such that the extended configuration comprises extended angle 290 when fully extended, where extended angle 290 is greater than retracted angle 190 of the retracted configuration of FIG. 1. Extended angle 290 and retracted angle 190 can be measured between legs 160 and bag sidewall 155 and/or between a portion of golf bag support mechanism 100 and bag sidewall 155, as described hereinbelow. In some examples, extended angle 290 can be approximately 40 degrees to approximately 60 degrees, and in particular, extended angle 290 can be approximately 50 degrees. In some example, retracted angle 190 can be approximately 0 degrees to approximately 20 degrees, and in particular, retracted angle 190 can be approximately 10 degrees. Golf bag support mechanism 100 is also configured to inhibit the extended configuration from degenerating with continued use or abuse, and to maintain extended angle 290 even when golf bag support mechanism 100 is subjected to heavy loads.

Figure 3:
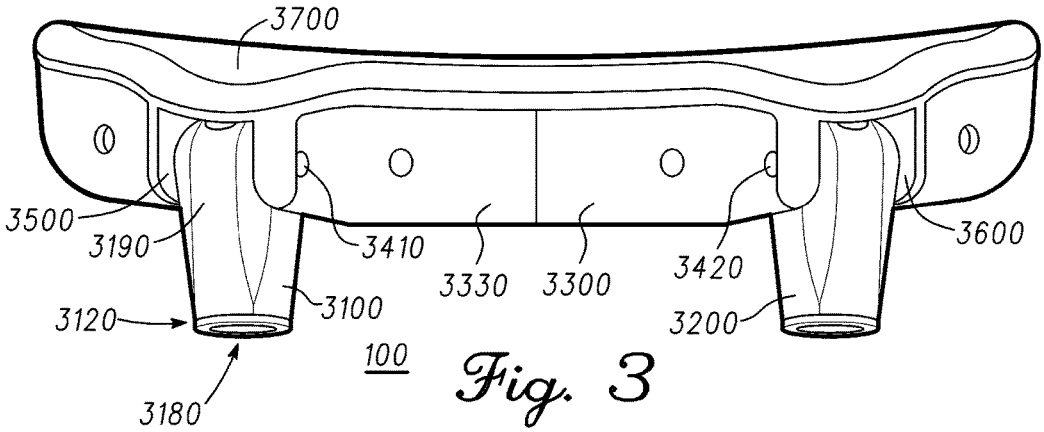
FIG. 3 illustrates a front view of the golf bag support mechanism in the retracted configuration.
Figure 4:
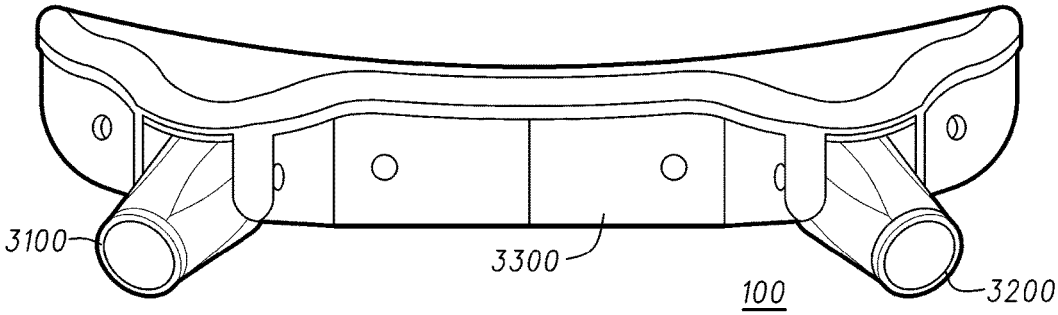
FIG. 4 illustrates a front view of the golf bag support mechanism in the extended configuration.

FIG. 3 illustrates a front view of golf bag support mechanism 100 in the retracted configuration. FIG. 4 illustrates a front view of golf bag support mechanism 100 in the extended configuration. In the present example, golf bag support mechanism 100 comprises bracket 3300, hinge member 3100, and hinge member 3200. Bracket 3300 comprises bracket wall 3330 and docks 3500 and 3600. Bracket wall 3330 can be coupled to a top portion of bag sidewall 155 of golf bag 150, such as seen in FIGS. 1-2, as part of golf bag support mechanism 100. A rear portion of bracket wall 3330 can thus be substantially parallel to bag sidewall 155 in at least some embodiments. Although bracket 3300 is shown herein as configured to couple to only a portion of a perimeter of bag sidewall 155 of golf bag 150 (FIGS. 1-2), there can be other embodiments with a similar bracket that couples completely around the top or upper perimeter of bag 150. Other portions of hinge members 3100 and 3200, and of docks 3500 and 3600, are explained hereinafter.

In the present example, docks 3500 and 3600 are integral with bracket wall 3330, comprising a single piece, but there may be other embodiments where at least a portion of one of docks 3500 or 3600 are not be integral with bracket wall 3330. Dock 3500 is configured to receive and hingedly couple with hinge member 3100 via clevis pin 3410. Similarly, dock 3600 is configured to receive and hingedly couple with hinge member 3200 via clevis pin 3420. By hinging about clevis pins 3410 and 3420, hinge members 3100 and 3200 can be extended or retracted relative to bracket wall 3330 between retracted angle 190 (FIG. 1) and extended angle 290 (FIG. 2) to establish the retracted configuration (FIG. 3) and the extended configuration (FIG. 4), respectively, for golf bag support mechanism 100.

Figure 5:
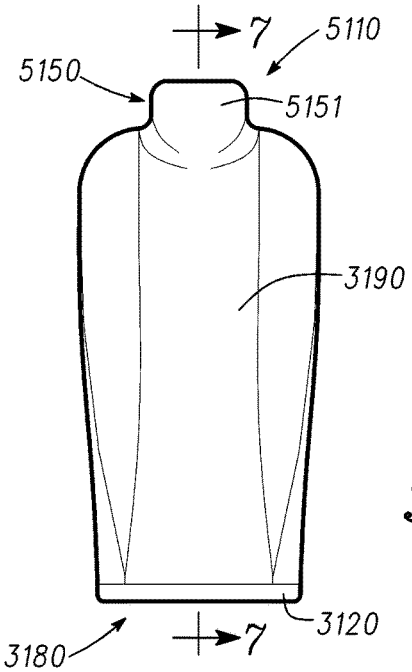
FIG. 5 illustrates a side view of a hinge member of the golf bag support mechanism.
Figure 6:
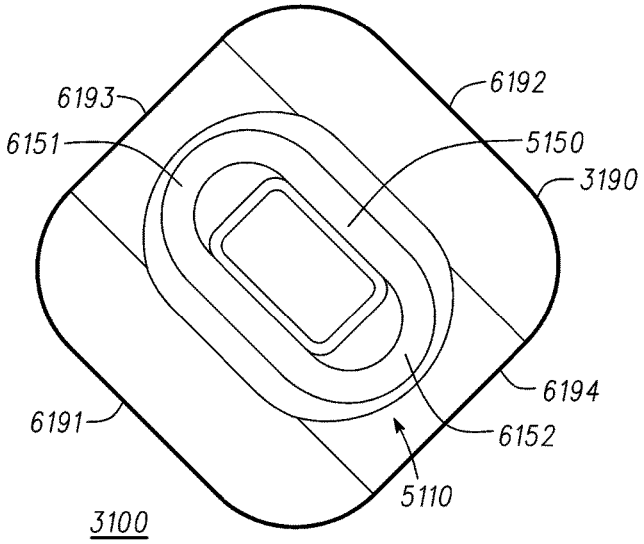
FIG. 6 illustrates a top view of the hinge member of FIG. 5.
Figure 7:
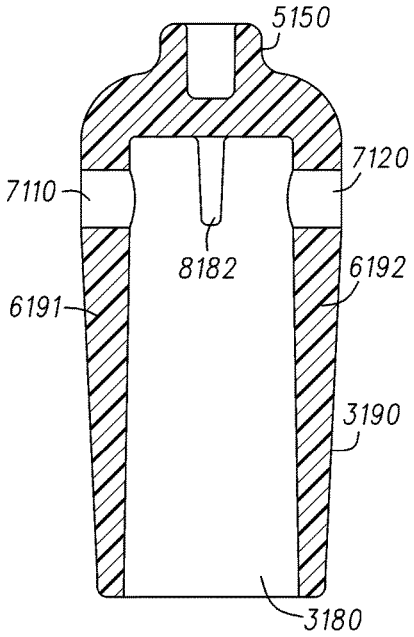
FIG. 7 illustrates a cross-sectional view of the hinge member along section line 7-7 in FIG. 5.
Figure 8:
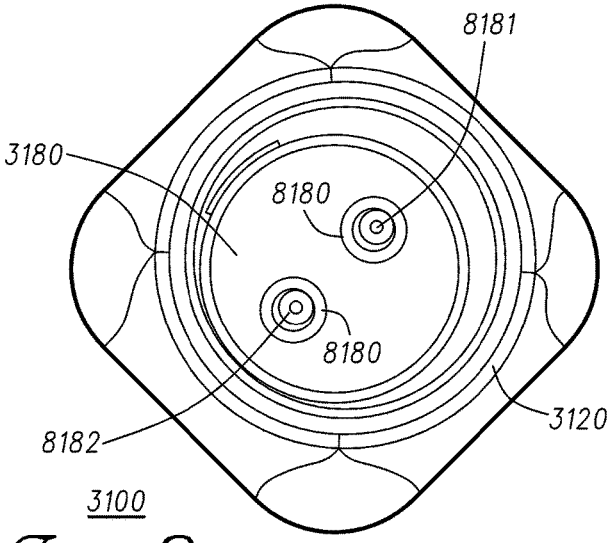
FIG. 8 illustrates a bottom view of the hinge member of FIG. 5.

FIG. 5 illustrates a side view of hinge member 3100. FIG. 6 illustrates a top view of hinge member 3100. FIG. 7 illustrates a cross-sectional view of hinge member 3100 along line 7-7 in FIG. 5. FIG. 8 illustrates a bottom view of hinge member 3100. In the present example, hinge members 3100 and 3200 (FIGS. 3 and 4) are interchangeable, such that FIGS. 5-8 could also represent hinge member 3200, and such that hinge member 3100 may be coupled to dock 3600 and hinge member 3200 may be coupled to dock 3500 (FIGS. 3-4) if desired.

As illustrated in FIGS. 5-8, hinge member 3100 comprises top end 5110, bottom end 3120 opposite top end 5110, sidewall 3190 extended between top end 5110 and bottom end 5120 and extended around a perimeter of hinge member 3100, and protrusion 5150 at top end 5110. Protrusion 5150 is centered at top end 5110, as can be seen in FIGS. 5-7, and comprises stop portion 5151. Hinge member 3100 also comprises bore 3180, through which one of legs 160 could be inserted to support golf club bag 150 (FIGS. 1-2). Section line 7-7 (FIG. 5) crosses through a middle of hinge member 3100, extending through a centerpoint of protrusion 5150 and between top end 5510 and bottom end 3120. In addition, hinge member 3100 comprises retention fingers 8180 (FIG. 8), which includes retention fingers 8181-8182 (FIG. 8) protruding from a deep end or inner end of bore 3180. Retention fingers 8181-8182 can be substantially parallel to each other. Other features of hinge member 3100 are explained hereinafter.

Figure 9:
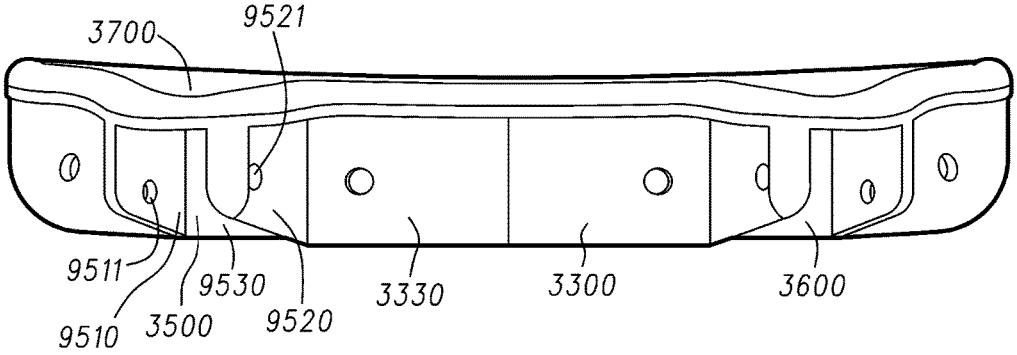
FIG. 9 illustrates a front view of a bracket of the golf bag support mechanism.
Figure 10:
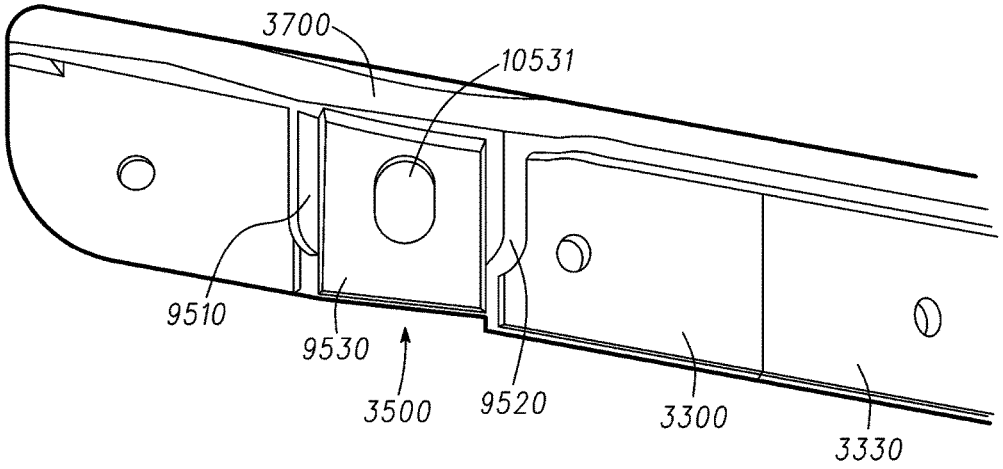
FIG. 10 illustrates a planar view of a dock of the bracket of FIG. 9.
Figure 11:
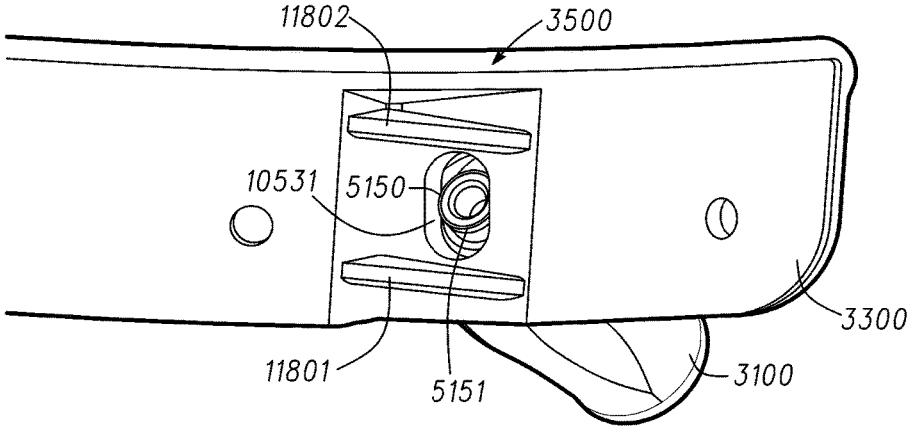
FIG. 11 illustrates a side rear view of the hinge member of FIGS. 5-8 coupled to the dock of the bracket of FIGS. 9-10 and in the extended configuration.
Figure 12:
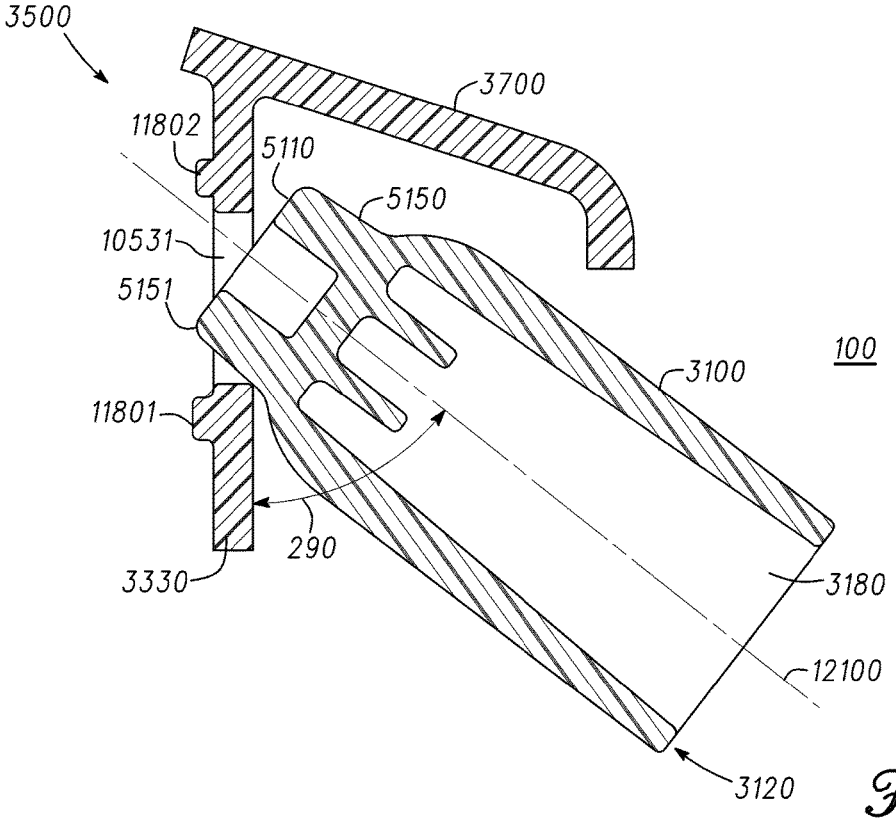
FIG. 12 is a side cross-sectional view of the hinge member of FIGS. 5-8 coupled to the dock of FIG. 10 and in the extended configuration.

FIG. 9 illustrates a front view of bracket 3300 of golf bag support mechanism 100. FIG. 10 illustrates a planar view of dock 3500. FIG. 11 illustrates a side rear view of hinge member 3100 coupled to dock 3500 and bracket 3300. FIG. 12 is a side cross-sectional view of hinge member 3100 coupled to dock 3500 and in the extended configuration. Dock 3600 (FIG. 9) can be substantially identical or symmetric to dock 3500.

As shown in FIG. 9, dock 3500 comprises back wall 9530 and dock ears 9510 and 9520 coupled to opposite ends of back wall 9530, where in the present example dock ears 9510 and 9520 extend substantially perpendicular to back wall 9530. In other examples, dock ears 9510 and/or 9520 may be angled differently relative to back wall 9530 in other embodiments. As explained hereinbelow, dock ears 9510 and 9520 of dock 3500 comprise ear apertures 9511 and 9521, respectively. Also in the present example, back wall 9530 comprises a portion of bracket wall 3330, although back wall 9530 and bracket wall 3330 may be separate or distinct from each other in other embodiments.

As shown in FIG. 10, back wall 9530 comprises notch 10531 extending into an outer bracket side of bracket wall 3330, where notch 10531 is configured to receive at least stop portion 5151 of protrusion 5150 (FIG. 5) when golf bag support mechanism 100 is in the extended configuration, as seen in FIGS. 11 and 12. Notch 10531 thus acts as a stop mechanism when coupled to stop portion 5151 of protrusion 5150 in the extended configuration to stop further rotation of hinge member 3100 when the extended configuration has been reached for golf bag support mechanism 100. As can be seen in FIG. 12, when golf bag support mechanism 100 is in the extended configuration, extended angle 290 can be measured between bracket wall 3330 and center axis 12100 of hinge member 3100. Retracted angle 190 (FIG. 1) of the retracted configuration also can be measured between bracket wall 3330 and center axis 12100 of hinge member 3100, when golf bag support mechanism 100 is in the retracted configuration, but is smaller than extended angle 290 (FIGS. 2, 12). When golf bag support mechanism 100 is in the retracted configuration, protrusion 5150 is fully decoupled from notch 10531 of dock 3500.

In the present example, protrusion 5150 of hinge member 3100 comprises a straight oval shape, where stop portion 5151 of protrusion 5150 is rounded, and where the bottom portion of notch 10531 is also rounded complementarily to stop portion 5151. Such roundness of the contact portions between notch 10531 and hinge member 3100 can permit contact stresses to be reduced by being better spread therebetween and by reducing areas of stress concentration, which can increase the load capacity of golf bag support system 100. There can be other embodiments, however, where protrusion 5150 can comprise other shapes, such as an oval, round, triangular, or flat shape. Such embodiments may also have their respective stop portions 5151 in a complementary shape, as well.

Notch 10531 extends completely through from the outer bracket side to the inner bracket side of bracket wall 3330 in the present example, such that part of stop portion 5151 of protrusion 5150 of hinge member 3100 extends through notch 10531 from the inner bracket side of bracket wall 3330 to or past the outer bracket side of bracket wall 3330. This arrangement permits protrusion 5150 to be taller and more robust than would otherwise be possible, and to reduce or spread out the contact stresses between stop portion 5151 and notch 10531 for better load capacity. In other embodiments, however, notch 10531 need not extend completely to the inner bracket side of bracket wall 3330.

As seen in FIGS. 11-12, reinforcing ribs 11801-11802 also provide further structural integrity to golf bag support mechanism 1100. Reinforcing ribs 11801-11802 extend substantially horizontally at both ends of notch 10531 to reinforce bracket 3300 at dock 3500. For example, reinforcing rib 11801 is located below and adjacent to the bottom portion of notch 10531. In some examples, at least reinforcing rib 11801 can provide further support with respect to the contact stresses or loads applied at the interface between notch 10531 and stop portion 5151 of protrusion 51510 when golf bag support mechanism is in the extended configuration. Accordingly reinforcing rib 11801 could support stop portion 5151 if the bottom portion of notch 10531 were to fail or wear out. Other embodiments, however, may dispense with one or both of reinforcing ribs 11801-11802, and or may have a different orientation for reinforcing ribs 11801-11802.

The present example also shows top wall 3700 (FIGS. 3, 9, 10, and 12) coupled to the top edge of bracket wall 3330 and above top edges of dock ears 9510 and 9520, where top wall 3700 extends outwards from, and substantially non-parallel to, bracket wall 3330. Top wall 3700 can further hide or protect the interface between dock 3500 and hinge member 3100, and may serve as a further guard against pinching the fingers or clothes of a user of the golf bag. As seen in FIG. 12, when golf bag support mechanism 100 is in the extended configuration, the engagement of protrusion 5150 of hinge member 3100 with notch 10531 of dock 3500 keeps hinge member 3100 fully decoupled from top wall 3700, such as to prevent or restrict any potential pinching towards the front end of top wall 3700, for example.

Figure 13:
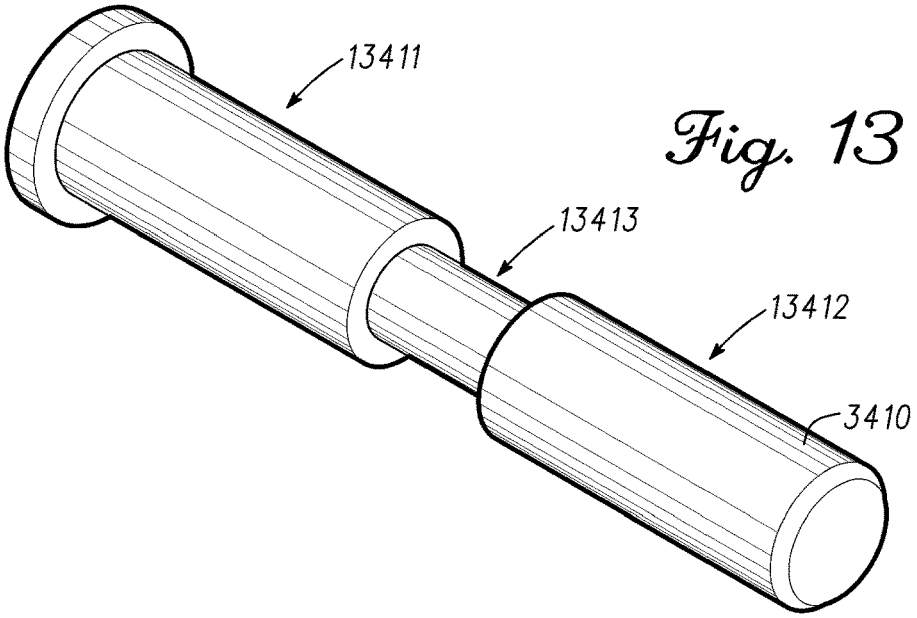
FIG. 13 shows a perspective view of a clevis pin about which the hinge member of FIGS. 5-8 partially rotates relative to the dock of FIG. 10.
Figure 14:
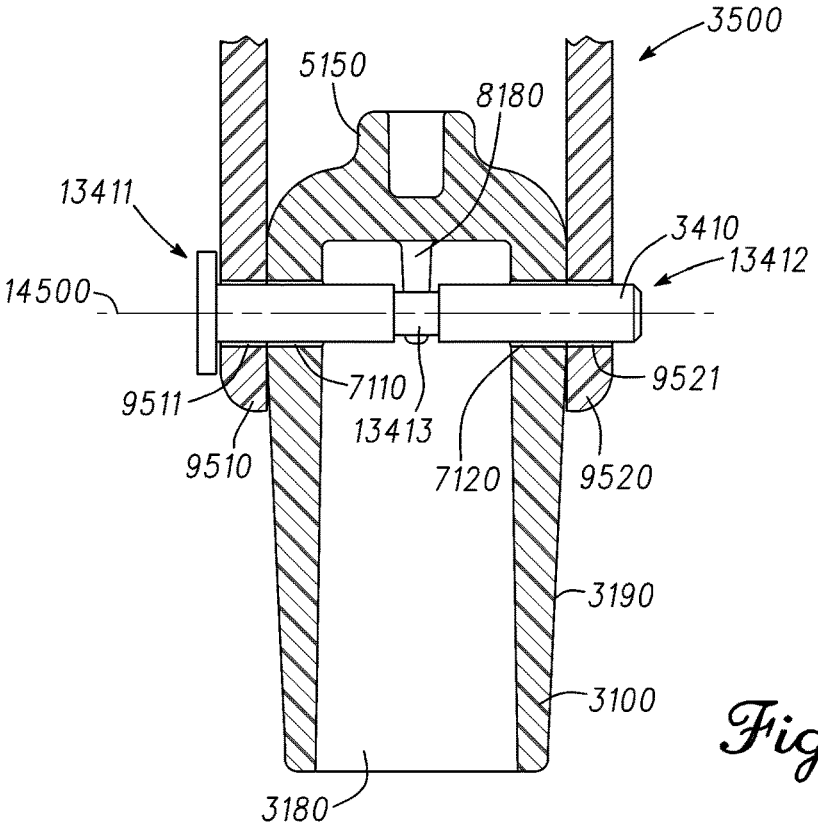
FIG. 14 shows a cross sectional view the hinge member of FIGS. 5-8 hinged to dock ears of the dock of FIG. 10 by the clevis pin of FIG. 13.

FIG. 13 shows a perspective view of clevis pin 3410, about which hinge member 3100 (FIGS. 3 and 4) partially rotates relative to dock 3500 (FIGS. 3 and 4). FIG. 14 shows a cross sectional view of hinge member 3100 hinged to dock ears 9510 and 9520 of dock 3500 by clevis pin 3410. As described above, dock ears 9510 and 9520 of dock 3500 comprise ear apertures 9511 and 9521, respectively (FIG. 9, 14). Similarly, hinge member 3100 comprises hinge aperture 7110 (FIG. 7, 14) at sidewall end 6191 (FIGS. 6, 7) of sidewall 3190, and hinge aperture 7120 (FIG. 7, 14) at sidewall end 6192 (FIGS. 6, 7) of sidewall 3190. Clevis pin 3410 is insertable along hinge axis 14500 into a hinge position wherein clevis pin 3410 traverses through each of ear aperture 9511, hinge aperture 7110, bore 3180, hinge aperture 7120, and then ear aperture 9521. As can be seen from FIGS. 13-14, clevis pin 3410 comprises head end portion 13411 and insertion end portion 13412 at opposite ends of clevis pin 3410. When clevis pin 3410 is in the hinge position (FIG. 14), insertion end portion 13412 protrudes out of dock 3500 through ear aperture 9521. In the present example, a maximum thickness of insertion end portion 13412 of clevis pin 3410 is complementary to aperture dimensions of each of ear apertures 9511 and 9521, and each of hinge apertures 7110 and 7120, such that a diameter of the maximum thickness of insertion end portion 13412 is not greater than the aperture dimensions through which clevis pin 3410 passes.

In addition, insertion end portion 13412 of clevis pin 3410 is devoid of a retention mechanism, such as a cotter pin mechanism or an arrowhead tip mechanism, to keep clevis pin 3410 from sliding out of ear aperture 9521 or hinge aperture 7120. Instead, clevis pin 3410 comprises a retention groove 13413 between head end portion 13411 and 13412, where retention groove 13413 at least partially circumscribes clevis pin 3410. A distance between retention fingers 8181-8182 (FIG. 8) is complementary with a thickness or diameter of clevis pin 3410 at retention groove 13413, but less than the thickness of clevis pin 3410 adjacent to either side of retention groove 13413. Retention fingers 8180 (FIG. 8) are configured to straddle retention groove 13413 when clevis pin 3410 is in the hinge position to inhibit insertion end 13412 from sliding out of ear aperture 9521 and hinge aperture 7120, thereby maintaining clevis pin 3410 in the hinge position shown in FIG. 14. In some examples, retention fingers 8181-8182 (FIG. 8) may be flexible enough to move out of the way as insertion end portion 13412 of clevis pin 3410 is inserted therebetween, and to snap back into place or otherwise move back into position once retention groove 13413 slides into position between retention fingers 8181-8182 as clevis pin 3410 is inserted into the hinge position.

Returning to FIG. 6, sidewall 3190 of hinge member 3100 comprises sidewall ends 6193-6194 opposite each other and located between sidewall ends 6191-6192. Protrusion 5150 comprises protrusion ends 6151 and 6152, which are substantially mirror images of each other at top end 5110. Protrusion 5150 is oriented such that protrusion end 6151 faces towards sidewall end 6193, and protrusion end 6152 faces towards sidewall end 6194. Accordingly, either of protrusion ends 6151 or 6152 can serve as stop portion 5151 to engage notch 10531 of dock 3500 (FIGS. 11-12). Hinge member 3100 is thus insertable into dock 3500 in more than one orientation. In one of such orientations, sidewall end 6193 can face back wall 9530 (FIG. 10) of dock 3500 when golf club support mechanism 100 is in the retracted configuration (FIG. 3), and protrusion end 6151 can act as stop portion 5151 to engage notch 10531 when golf club support mechanism 100 is in the extended configuration (FIGS. 4, 11, 12). In another one of such orientations, sidewall end 6194 can face back wall 9530 (FIG. 10) of dock 3500 when golf club support mechanism 100 is in the retracted configuration (FIG. 3), and protrusion end 6152 can act as stop portion 5151 to engage notch 10531 when golf club support mechanism 100 is in the extended configuration (FIGS. 4, 11, 12). Such features described above can ease manufacturing and/or assembly concerns, wherein hinge member 3100 and dock 3500 do not need to be assembled in one specific orientation relative to each other. Similarly, hinge member 3100 can be interchangeable with hinge member 3200, and can be coupled with dock 3600 instead of dock 3500 (FIG. 3), thereby further easing the manufacturing and assembly process for golf bag support mechanism 100.

As can be seen in FIG. 12, bore 3180 of hinge member 3100 is centered about center axis 12100, extending into bottom end 3120 and towards top end 5110 of hinge member 3100. Bore 3180 is configured to receive a first end of a support leg, such as one of support legs 160 (FIGS. 1-2), where the second end of the support leg can be used to support golf bag 150 over support surface 210, along with golf bag bottom 151, when golf bag support mechanism 100 is in the extended configuration (FIG. 2). Under such a configuration, and with reference to FIG. 12, stop portion 5151 of protrusion 5150 of hinge member 3100 can push against notch 10531 of dock 3500 in a direction substantially parallel to and/or along bracket wall 3330 and/or bag sidewall 150. In some examples, the ability of golf bag support mechanism 100 to push against notch 10531 in a direction along and/or substantially parallel to bracket wall 3330 can be beneficial, for example to provide better durability, load capacity, and/or resistance to overextension past extension angle 290 than if protrusion 5150 were to push against notch 10531 or dock 3500 in a direction substantially perpendicular to bracket wall 3330 and/or bag sidewall 150. In addition, because bracket wall 3330 faces bag sidewall 155, such that the engagement of notch 10531 with protrusion 5150 in the extended configuration is concealed by bag sidewall 155 and is not accessible externally, golf club support mechanism 100 is configured to eliminate or restrict the possibility of pinching or other injuries that would likely occur if hinge member 3100 were to engage notch 10531 via an otherwise exposed coupling mechanism.

Figure 15:
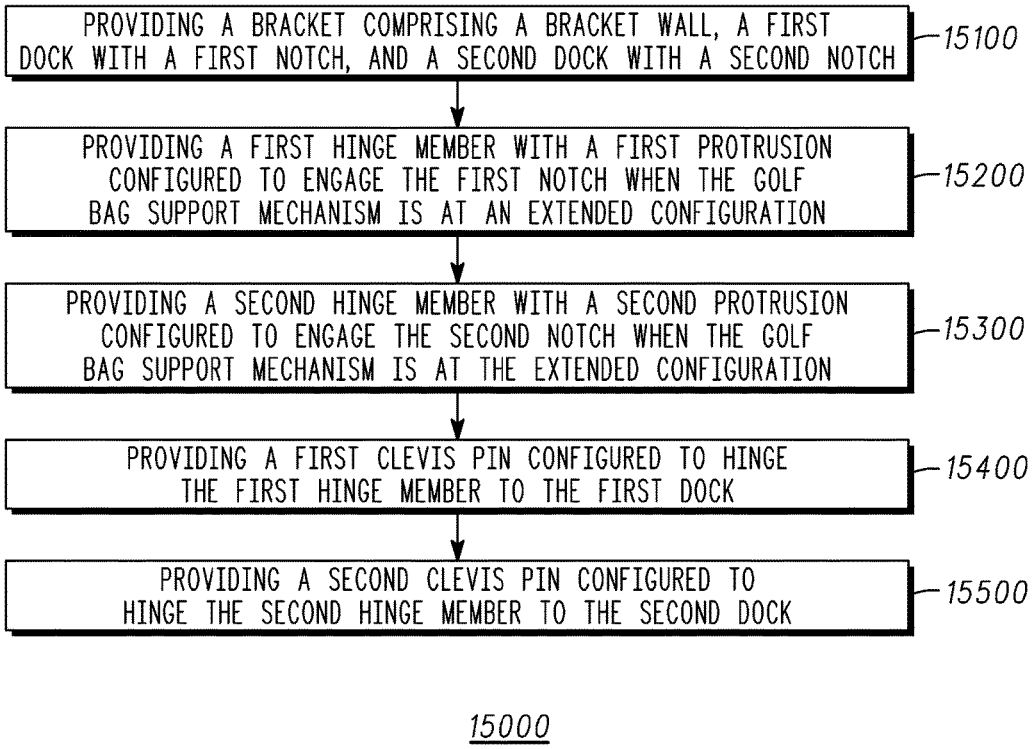
FIG. 15 illustrates a flowchart of a method for providing a golf bag support mechanism.

Moving along, FIG. 15 illustrates a flowchart of method 15000 for providing a golf bag support mechanism. In some examples, the golf bag support mechanism of method 15000 can be similar to golf bag support mechanism 100 as described above with respect to FIGS. 1-14.

Block 15100 of method 15000 comprises providing a bracket comprising a bracket wall, a first dock with a first notch, and a second dock with a second notch. In some examples, the bracket can be similar to bracket 3300 (FIG. 3). Also, the first dock can be similar to dock 3500 (FIG. 3), and the second dock can be similar to dock 3600 (FIG. 3), or vice versa. In the same or other examples, the first and/or second notches can be similar to notch 10531 (FIGS. 10-12).

Block 15200 of method 15000 comprises providing a first hinge member with a first protrusion configured to engage the first notch when the golf bag support mechanism is at an extended configuration. In some examples, the first hinge member can be similar to hinge member 3100 (FIGS. 3-8, 11-12, and 14), and the first protrusion can be similar to protrusion 5150 (FIGS. 5-7, 11-12, and 14). The extended configuration can be similar to the extended configuration described above with respect to FIGS. 2, 4, and 11 for golf bag support mechanism 100.

Block 15300 of method 15000 comprises providing a second hinge member with a second protrusion configured to engage the second notch when the golf bag support mechanism is at the extended configuration. In some examples, the second hinge member can be similar to hinge member 3200 (FIGS. 3-4), and the second protrusion can be similar to protrusion 5150 (FIGS. 5-7, 11-12, and 14).

Block 15400 of method 15000 comprises providing a first clevis pin configured to hinge the first hinge member to the first dock. In some examples, the first clevis pin can be similar to clevis pin 3410 (FIGS. 3, and 13-14), and also can be similar to clevis pin 3420 (FIG. 3).

Block 15500 of method 15000 comprises providing a second clevis pin configured to hinge the second hinge member to the second dock. In some examples, the second clevis pin can be similar to clevis pin 3420 (FIG. 3), and also can be similar to clevis pin 3410 (FIGS. 3, and 13-14).

In some examples, one or more of the different blocks of method 15000 can be combined into a single block or performed simultaneously, and/or the sequence of such blocks can be changed. For example, blocks 15200 and 15300, and/or blocks 15400 and 15500, may be performed simultaneously. As another example, blocks 15200 and 15300 can be performed prior to block 15100. In the same or other examples, some of the blocks of method 15000 can be subdivided into several sub-blocks. For example, block 15100 can be subdivided into sub-blocks, each providing a different one of the bracket wall, the first dock, and the second dock. There can also be examples where method 15000 can comprise further or different blocks. As an example, method 15000 can comprise another block for providing a golf club bag and/or for attaching the bracket to the golf club bag. In addition, there may be examples where method 15000 can comprise only part of the steps described above. For instance, in some examples, blocks 15300 and 15500 may not be needed, and the bracket of block 15100 need not comprise the second dock with the second notch. Other variations can be implemented for method 15000 without departing from the scope of the present disclosure.

Although the golf bag support mechanisms and related methods herein have been described with reference to specific embodiments, various changes may be made without departing from the spirit or scope of the present disclosure. Additional examples of such changes have been given in the foregoing description. Other permutations of the different embodiments having one or more of the features of the various figures are likewise contemplated. Accordingly, the specification and drawings herein are intended to be illustrative of the scope of the disclosure and is not intended to be limiting. It is intended that the scope of this application shall be limited only to the extent required by the appended claims.

The golf bag support mechanisms and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a golf club bag, the apparatus, methods, and articles of manufacture described herein may be applicable to other types of bags or items designed to carry other equipment. Alternatively, the apparatus, methods, and articles of manufacture described herein may be applicable to other bags or utensils to carry different kinds of sports equipment, such as hockey sticks, tennis rackets, fishing poles, ski poles, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf bag support mechanism comprising:

a bracket comprising:

a bracket wall comprising an outer bracket side and an inner bracket side opposite the outer bracket side; and a first dock adjacent to the outer bracket side of the bracket wall; and a first hinge member configured for hinged coupling with the first dock;

wherein:

the first hinge member comprises:

a first top end;

a first bottom end opposite the first top end;

a first sidewall extended between the first top end and the first bottom end;

a first protrusion protruding from the first top end and comprising a stop portion; and a first bore bounded by the first sidewall;

a first axis extends between the first top end and the first bottom end of the first hinge member;

the first bore is centered about the first axis;

the first dock comprises a first notch extending into the outer bracket side of the bracket wall;

the first dock comprises:

a first back wall comprising the first notch; and a plurality of reinforcing ribs, wherein the plurality of reinforcing ribs are integral with the first dock;

first and second ears coupled substantially perpendicular to, and at opposite ends of, the first back wall;

the first ear comprises a first ear aperture;

the second ear comprises a second ear aperture;

a first clevis pin configured to hinge the first hinge member to the first dock; the first clevis pin comprises:

a head end portion comprising a clevis head; and an insertion end portion configured to protrude out of the second ear aperture when the clevis pin is in a hinge position;

the insertion end portion is devoid of a retention mechanism; and a maximum thickness of the insertion end portion is complementary to aperture dimensions of each of the first and second ear apertures and a first and second hinge apertures;

wherein:

the plurality of reinforcing ribs are adjacent to at least one end of the first notch; and the first hinge member comprises:

a first sidewall end of the first sidewall, the first sidewall end comprising the first hinge aperture; and a second sidewall end of the first sidewall and opposite the first sidewall end, the second sidewall end comprising the second hinge aperture; and the first clevis pin is insertable along a hinge axis of the first hinge member into the hinge position to hinge the first hinge member with the first dock, the hinge position comprising the first clevis pin in the first ear aperture, the first hinge aperture, the first bore, the second hinge aperture, and the second ear aperture, wherein an inner end of the first bore of the first hinge member comprises a first and second fingers protruding therefrom; and the first clevis pin comprises a first groove between the head end portion and the insertion end portion and at least partially circumscribing the first clevis pin;

a distance between the first and second fingers is: complementary with a thickness of the first clevis pin at the first groove; and less than a thickness of the first clevis pin adjacent to either side of the first groove; and the first and second fingers are configured to straddle the first groove when the first clevis pin is in the hinge position to restrict the clevis pin from sliding out of the hinge position; and the first and second fingers comprise a flexible material; and the golf bag support mechanism is configurable between a retracted configuration and an extended configuration; and when the golf bag support mechanism is in the extended configuration: an extended angle exists between the first axis and the bracket wall; and the stop portion of the first protrusion is received at least partially within the first notch.

2. The golf bag support mechanism of claim 1, wherein: the first axis is fully bounded by the first protrusion; and the bracket is configured to be coupled to a top bag portion of a golf bag such that the inner bracket side faces toward the golf bag.

3. The golf bag support mechanism of claim 1, wherein: the first hinge member comprises a hinge axis for the hinged coupling with the first dock; the first protrusion comprises a protrusion first dimension orthogonal to the first axis and orthogonal to the hinge axis; and the first axis intersects a centerpoint of the protrusion first dimension.

4. The golf bag support mechanism of claim 3, wherein: the protrusion first dimension comprises a first protrusion length of the first protrusion.

5. The golf bag support mechanism of claim 3, wherein: the protrusion first dimension comprises a first protrusion length of the first protrusion; and the first axis is fully bounded by the first protrusion.

6. The golf bag support mechanism of claim 3, wherein: the first protrusion comprises a protrusion second dimension orthogonal to the protrusion first dimension; and the first axis intersects a centerpoint of the protrusion second dimension.

7. The golf bag support mechanism of claim 1, wherein: the first protrusion comprises: a first protrusion width measured orthogonal to the first axis; and a first protrusion length measured orthogonal to the first axis; the first top end comprises: a first top end width measured orthogonal to the first axis; and a first top end length measured orthogonal to the first axis; the first top end length is greater than the first protrusion length; and the first notch of the first dock is at least as wide as the first protrusion width of the first protrusion, but narrower than the first top end width and the first top end length of the first top end.

8. The golf bag support mechanism of claim 1, wherein: the first hinge member comprises a hinge axis for the hinged coupling with the first dock; the first protrusion comprises: a first protrusion length orthogonal to the first axis and orthogonal to the hinge axis; and a first protrusion width orthogonal to the first protrusion length; and the first protrusion length is greater than the first protrusion width.

9. The golf bag support mechanism of claim 1, wherein: a curved surface of the stop portion of the first protrusion is complementary with and received by a curved surface of the first notch of the first dock when the golf bag support mechanism is in the extended configuration.

10. The golf bag support mechanism of claim 1, wherein: the bracket is configured to be coupled to a top bag portion of a golf bag; and the bracket wall is configured to be coupled with, and substantially parallel to, a bag sidewall at the top bag portion.

11. The golf bag support mechanism of claim 10, wherein: the first bore of the first hinge member is configured to receive a first end of a first support leg; and when the golf bag support mechanism is in the extended configuration while coupled to the bag sidewall, while the first end of the first support leg is received in the first bore of the first hinge member, and while a bottom of the golf bag and a second end of the first support leg are supported over a support surface, the stop portion of the first protrusion contacts a bottom end of the first notch.

12. The golf bag support mechanism of claim 1, wherein: the first protrusion comprises a straight oval shape having: first and second rounded ends opposite each other; and a midsection separating the first and second rounded ends from each other and comprising first and second straight-line sides.

13. The golf bag support mechanism of claim 1, wherein: the stop portion of the first protrusion comprises a rounded protrusion stop surface; a bottom end of the first notch comprises a rounded notch stop surface that is rounded complementarily with the rounded protrusion stop surface of the stop portion of the first protrusion; and when the golf bag support mechanism is in the extended configuration, the rounded protrusion stop surface pushes along the rounded notch stop surface when received therein.

14. The golf bag support mechanism of claim 1, wherein: the first hinge member comprises:

a third sidewall end of the first sidewall, located between the first and second sidewall ends; and a fourth sidewall end of the first sidewall, located between the first and second sidewall ends;

and opposite the third sidewall end; the first protrusion comprises:

a first protrusion end facing towards the third sidewall end;

and a second protrusion end facing towards the fourth sidewall end;

the first and second protrusion ends are substantially mirror images of each other relative to the hinge axis;

the first hinge member is insertable into the first dock in a first orientation where the third sidewall end faces the first back wall of the first dock when the golf bag support mechanism is in the retracted configuration and the first protrusion end engages the first notch when the golf bag support mechanism is in the extended configuration; and the first hinge member also is insertable into the first dock in a second orientation where the fourth sidewall end faces the first back wall of the first dock when the golf bag support mechanism is in the retracted configuration and the second protrusion end engages the first notch when the golf bag support mechanism is in the extended configuration.

15. The golf bag support mechanism of claim 1, wherein: the extended angle comprises between approximately 40 to approximately 60 degrees.

16. The golf bag support mechanism of claim 1, wherein:

the bracket wall comprises one or more reinforcing ribs protruding therefrom opposite the first dock and at the inner bracket side of the bracket wall; and at least a first rib of the one or more reinforcing ribs is located below and adjacent to a bottom portion of the first notch.

17. The golf bag support mechanism of claim 1, wherein:

the bracket further comprises:

a top wall extending from a top of the bracket wall and non-parallel thereto, the top wall comprising a first side facing the first hinge member and coupled to the first and second ears;

at least when the golf bag support mechanism is in the extended configuration, the first hinge member is still coupled with the first side of the top wall; and the plurality of reinforcing ribs are substantially parallel with the top wall.

18. The golf bag support mechanism of claim 1, further comprising:

a second hinge member comprising:

a second protrusion at a second top end of the second hinge member; and a second axis extended through a centerpoint of the second protrusion;

wherein:

the bracket further comprises a second dock adjacent to the outer bracket side of the bracket wall;

the second hinge member is hingedly coupled with the second dock;

when the golf bag support mechanism is in the extended configuration:

a second extended angle exists between the second axis and the bracket wall; and the second extended angle is commensurate with the extended angle.

* * * * *